US007223037B2

(12) United States Patent
Furukawa et al.

(10) Patent No.: US 7,223,037 B2
(45) Date of Patent: May 29, 2007

(54) PRODUCTION PROCESSES FOR WRITING INSTRUMENT AND INK OCCLUSION BODY

(75) Inventors: Kazuhiko Furukawa, Kanagawa (JP); Yojiro Sano, Setagaya-ku (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/480,941

(22) PCT Filed: Jun. 26, 2002

(86) PCT No.: PCT/JP02/06426

§ 371 (c)(1),
(2), (4) Date: Dec. 16, 2003

(87) PCT Pub. No.: WO03/002356

PCT Pub. Date: Jan. 9, 2003

(65) Prior Publication Data

US 2004/0131415 A1 Jul. 8, 2004

(30) Foreign Application Priority Data

Jun. 29, 2001 (JP) ..... 2001-200129

(51) Int. Cl.
*B43K 5/02* (2006.01)
*B43K 5/00* (2006.01)

(52) U.S. Cl. ..... 401/224; 401/222; 401/198; 401/199

(58) Field of Classification Search ..... 401/151, 401/198, 199, 222, 223, 224, 230
See application file for complete search history.

(56) References Cited

U.S. PATENT DOCUMENTS

| | | | | |
|---|---|---|---|---|
| 3,442,597 | A * | 5/1969 | Anweiler et al. | 401/259 |
| 3,737,242 | A * | 6/1973 | Hesebeck et al. | 401/157 |
| 6,607,325 | B2 * | 8/2003 | Hori | 401/205 |

FOREIGN PATENT DOCUMENTS

| | | |
|---|---|---|
| JP | 7-8234 | 3/1995 |
| WO | 99/56969 | 11/1999 |
| WO | 01/85471 | 11/2001 |

OTHER PUBLICATIONS

JPO Publication No. 2001-315483- abstract only.*

* cited by examiner

*Primary Examiner*—David J. Walczak
(74) *Attorney, Agent, or Firm*—Buchanan, Ingersoll & Rooney PC

(57) ABSTRACT

Provided is a writing instrument comprising an ink tank, an ink holder which can hold an ink, a pen tip, an ink guiding part for guiding the ink in the ink tank to the pen tip and an ink occlusion body which can feed the ink to the ink guiding part and which has an outer skin, wherein through parts are provide in the outer skin of the ink occlusion body.

6 Claims, 9 Drawing Sheets

PRODUCTION PROCESSES FOR WRITING INSTRUMENT AND INK OCCLUSION BODY

TECHNICAL FIELD

The present invention relates to production processes for a writing instrument such as a ballpoint pen and a felt-tip pen and an ink occlusion body used for the same.

BACKGROUND ART

As shown in Japanese Patent Application Laid-Open No. 348487/1999, a writing instrument in which a liquid ink and an ink occlusion body (sliver) having an outer skin are mounted in an ink tank has so far been known. The writing instrument having such structure does not deteriorate so much the writing performances of a free ink type writing instrument which have so far been exhibited, and has the effect of preventing an ink from leaking to the outside of the writing instrument even when air in the inside of the ink tank is expanded due to a change in temperature and pressure. However, the writing instrument shown in Japanese Patent Application Laid-Open No. 348487/1999 has the following problem that arises from mounting therein an ink occlusion body (sliver) having an outer skin, though having the effect of preventing an ink from leaking.

Conventional problems shall be explained with reference to FIG. 9 and FIG. 10. A method for charging an ink occlusion body (sliver) and an ink into an ink tank includes various methods. It includes, for example, a method in which an ink is charged into an ink tank to some extent and then an ink occlusion body impregnated with the ink is charged into the ink tank, a method in which an ink is charged into an ink tank and then an ink occlusion body impregnated with no ink is charged into the ink tank and a method in which, as shown in FIG. 9, an ink occlusion body 3 is charged into an ink tank 1 and then the ink occlusion body 3 is impregnated with an ink 6 while introducing the ink into the ink tank 1. In these methods, the ink occlusion body 3 has to be impregnated with the ink 6 from a lower part thereof so that air does not remain in the inside of the ink occlusion body 3.

A prescribed amount of the ink is charged thereinto, and then an ink holder 7 is pressed into the ink tank 1 from its aperture to complete a writing instrument. After completion, the writing instrument is upset to turn a pen tip part 9 downward, so that the ink 6 passes through between an outer skin 2 and the inner wall of the ink tank 1 to flow toward the pen tip part 9. No problem is brought about when the ink occlusion body 3 is completely impregnated with the ink, but if not completely impregnated, the ink occlusion body starts to be impregnated with the ink as well from the lower part (pen tip part 9 side) thereof, so that a void part 13 is produced in the ink occlusion body 3. If writing is continued in this state, caused are the problems that the void part 13 makes it impossible to effectively consume the ink in the upper part (reverse side to the pen tip part 9) than the void part 13 and that the void part causes inferior writing. These problems are liable to be brought about even if any of the charging methods described above is employed.

Further, when an ink occlusion body is merely mounted in an ink tank, the state that a gas-liquid exchange part is not wetted is brought about in a certain case, and an ink head applied to a pen tip is increased. As a result, the problem that an ink leaks from a pen tip part is caused.

An object of the present invention is to solve the problems brought about when an ink occlusion body having an outer skin is mounted in the inside of an ink tank, that is, to provide a writing instrument which prevents an ink void part from being produced in the ink occlusion body and which can effectively consume an ink and does not cause inferior writing.

Further, an object thereof is to solve the problem that when an ink occlusion body is mounted in an ink tank, an ink head applied to a pen tip is increased and as a result, an ink leaks from a pen tip part.

DISCLOSURE OF THE INVENTION

In order to achieve the objects described above, the present invention provides a writing instrument comprising an ink tank for storing a liquid ink in an inside thereof, an ink holder which can hold the ink in the ink tank, a pen tip, an ink guiding part for guiding the ink in the ink tank to the pen tip and an ink occlusion body having an outer skin which can feed the ink to the ink guiding part, wherein through parts are provide in the outer skin of the ink occlusion body.

Various inks can be used for the ink used for the writing instrument of the present invention and include, for example, low (or intermediate) viscosity inks having a viscosity of 2 to 100 mPa·s at room temperature (about 23° C.). Further, allowed to be applied is an ink obtained by slightly lowering a viscosity of a pseudo-plastic ink (called a gel ink) which has a little high viscosity in a still standing state to prevent direct flow that an ink leaks from the point of a pen tip part and which is reduced in a viscosity when moving or shearing is caused by writing to make it possible to smoothly write. Capable of being used as a solvent which is a base for an ink are not only usual water but also lower alcohols, higher alcohols and organic solvents such as xylene, glycols such as ethylene glycol and esters thereof. In addition thereto, various known inks can suitably be used.

Capable of being used for the ink occlusion body as long as they have a performance to hold an ink to some extent are an article obtained by softly fixing yarns of short fibers or long fibers in an outer skin as used for a conventional sliver type writing instrument, a so-called fiber bundle which maintains a form with binding yarns of long fibers by means of an adhesive or heat fusion, an article obtained by molding a plastic to have a snow crystal-like cross section by extrusion, an article obtained by fixing small particles of metal, ceramic or a plastic by heat or an adhesive while maintaining pores and sintering them, and a sponge. A capillary force in the inside can suitably be controlled by the number of the fibers.

The outer skin includes polypropylene (PP), polyvinyl chloride and polyethylene terephthalate (PET). The outer skin in the present invention does not necessarily mean only an outer skin formed by a part and a material which are different from those of the ink occlusion body and includes as well a matter which substantially prevents an ink from passing through, like a matter formed by impregnating the surface of an ink occlusion body with an adhesive to fix the surface.

The ink guiding part is a part for guiding an ink from the ink tank to the pen tip part, and it can be prepared from the same material as that of the ink occlusion body. A performance to introduce an ink from the ink tank to the pen tip part is required, and therefore the ink guiding part is usually prepared so that it has stronger capillary force than the ink occlusion body has.

The pen tip part includes a ballpoint pen tip in which a ball is held at a point of a holder and a pen tip formed from fibers and a resin which is used for a felt-tip pen. The ink guiding part and the pen tip part do not necessarily have to be different parts and may be integrated. In this case, the periphery of a part brought into contact with a matter to be written such as a paper face corresponds to the pen tip part.

The color of the ink tank is desirably transparent, because the amount of the ink remaining in the inside thereof can be observed. Various materials can be used therefor, and polypropylene (PP) is usually used.

The ink holder has a function to control the internal pressure of the inside of the ink tank, wherein when the internal pressure of the inside of the ink tank rises, the ink in the ink tank is held, and on the contrary, when the internal pressure is reduced, the ink in the ink holder is returned to the ink tank or air is allowed to flow thereinto from a gas-liquid exchange part, whereby the internal pressure is controlled. The ink holder includes one in which tabular blades are continuously provided in an axial direction to thereby form holding grooves between the blades and another type absorbing an ink with a sponge-like substance.

The through parts in the outer skin of the ink occlusion body are to communicate the inside of the ink occlusion body with the outside thereof, and the shape thereof includes a through hole and a slit, but shall not be restricted to them. The presence of the through parts provides the effect to impregnate the ink occlusion body with the ink from various directions.

The through parts described above can be provided in a wide range extending over the whole length of the outer skin. In this case, even if the ink occlusion body is cut in any position in manufacturing the ink occlusion body, the through parts are liable to be positioned in a portion where a void part is liable to be produced, and there is the effect that the position to be cut may not strictly be controlled. Further, the through parts can be provided around the whole periphery at regular intervals extending over the whole length of the outer skin. Also in this case, even if the ink occlusion body is cut in any position in manufacturing the ink occlusion body, the through parts are liable to be positioned in a portion where a void part is liable to be produced, and there provided are the effects that the position to be cut may not strictly be controlled and that the directionality does not have to be controlled in installing the ink occlusion body into the ink tank.

The through hole includes various ones such as an ellipsoidal form, a square form and a polygonal form as well as a circular form. Further, the hole does not have to have a closed form and may have a form in which it is opened at the end part 23 of the ink occlusion body as shown in FIG. 8. The form of the slit shall not specifically be restricted as well. The width and the length can suitably be set up. In FIG. 8, a through hole 15 which is a through part is provided at a pen tip part 9 side rather than in the middle of an ink occlusion body 3.

The positions of the trough hole and the slit shall not specifically be restricted as well. They may be provided extending over the whole length of the ink occlusion body or at a part thereof. They are provided more preferably at the pen tip part side rather than in the middle, and in this case, a void part of an ink in the ink occlusion body can effectively be prevented.

The through parts described above are characterized by lining up in an axial direction. In this case, "lining up in an axial direction" is not necessarily restricted to lining up on a straight line. It shall be included in the scope of the present invention even if lines on which the through parts line up are deviated from each other. This makes it possible to impregnate the ink occlusion body with an ink extending over a wide range in the axial direction and provides the effect that the void part can effectively be prevented.

The writing instrument of the present invention is a writing instrument in which an ink guiding part is inserted into an ink occlusion body, and it is characterized in that the through parts described above are provided at the pen tip side rather than in the middle of the ink occlusion body. In this case, spots in which the through parts are provided can be reduced, and therefore the cost can be cut by reducing the production steps. A void part is liable to be produced at the pen tip side, and therefore the void part can effectively be prevented from being produced even if the spots in which the through parts are provided are restricted in the manner described above.

More preferred embodiment is to provide the through parts in the periphery of the part in which the ink guiding part is inserted into the ink occlusion body. If the void part is present in the periphery of the part in which the ink guiding part is installed into the ink occlusion body, it is highly likely to lead to inferior writing, and this also provides the effect that the spots in which the through parts are provided can be decreased more.

Also, further preferred embodiment is characterized in that provided that the outer diameter of the ink occlusion body is d and a pitch in which the through parts are provided is P, P is not larger than 2 d. A large interval between the through parts increases the possibility that the void part is produced. Satisfaction of this relation can control the interval between the through parts and effectively prevent the void part from being produced.

Further, the present invention provides a production process for the ink occlusion body having the outer skin in which the through parts are provided and is characterized in that the ink occlusion body having the outer skin in which the through parts are provided is molded and then cut to a dimension in which it can be inserted into the ink tank. That is, in this method, the through parts are not provided later in the ink occlusion body having the outer skin cut to a dimension in which the ink occlusion body can be inserted into the ink tank, and instead, after molding the ink occlusion body having the outer skin in which the through parts are provided, it is cut to a dimension in which the ink occlusion body can be inserted into the ink tank.

The ink occlusion body having the outer skin is molded by various methods, and they include, for example, extrusion molding. The ink occlusion body and the outer skin are thermally fused while extruding them at the same time. A method for providing the through parts includes a method in which after extrusion-molding as described above, a through hole is provided at the side part by means of a punch and a method in which a slit is provided on an outer skin at the time of extrusion using a mouthpiece having a C letter form in extrusion-molding. In the present invention, the through holes or the slits which are the through parts are provided on the outer skin as described above, and the ink occlusion body is then cut to a dimension in which it can be inserted into the ink tank.

The production process described above has the effect that the production step for providing the through parts is facilitated. In the case of the method in which the through parts are provided later on the individual ink occlusion body having the outer skin cut to a dimension in which it can be inserted into the ink tank, the ink occlusion body having the outer skin which is shortened with cutting is to be handled. The ink occlusion body is usually light and soft, and it is difficult as compared with metal parts and resin molded articles to handle such light and soft ink occlusion body. Particularly in an automatic assembling machine, steps for transporting and fixing the light and soft ink occlusion body are required in order to provide the through parts, and the difficulty becomes more notable. In the process of the present invention, the through parts are already provided in the cutting stage, and therefore it has the effect that the problem on the handling described above can be solved.

More preferred embodiment is to provide the through parts in a wide range extending over the whole length of the outer skin. The reason therefor is that even if the ink occlusion body is cut in any position, the through parts are liable to be positioned in a portion where a void part is liable to be produced and that the position to be cut may not strictly be controlled. Further preferred embodiment is to provide the through parts at regular intervals extending over the whole length and over the whole periphery of the outer skin. Also in this case, the reason therefor is that even if the ink occlusion body is cut in any position, the through parts are liable to be positioned in a portion where the void part is liable to be produced and that the position to be cut may not strictly be controlled and the directionality does not have to be controlled in installing the ink occlusion body into the ink tank.

The ink holder described above is characterized by having a gas-liquid exchange part and an ink-guiding path for guiding an ink to the above gas-liquid exchange part.

It shall be explained with reference to FIG. 1 how an ink is consumed in a writing instrument mounting therein an ink occlusion body. When writing is continued, an ink is consumed, and the ink present between an outer skin 2 and the inner wall of an ink tank 1 is first exhausted. Thereafter, the ink present in an ink occlusion body 3 is consumed. In a stage where the ink present between the outer skin 2 and the inner wall of the ink tank 1 still remains, the ink wets a gas-liquid exchange part 11, and it is designed so that the inside of the ink tank 1 stays in a negative pressure state by the action of meniscus and the ink does not leak from a pen tip part 9. In this case, a head of the ink H1 is applied to the pen tip part 9.

However, when a stage where the ink present in the ink occlusion body 3 is consumed is reached, the state that the gas-liquid exchange part 11 does not wet occurs, and a head of the ink is changed from H1 to H2. Conventional writing instruments are designed based on the premise that the ink head is H1, and therefore when the ink head H2 over the ink head H1 is applied, the ink comes to leak from the pen tip part 9.

In the present invention, this problem is solved by providing an ink guiding path 20. As shown in FIG. 2 and FIG. 6, providing of the ink guiding path 20 connected to the gas-liquid exchange part 11 makes it possible to always wet the gas-liquid exchange part 11 and allow the ink head to stay in H1. As a result, it is possible to prevent the ink from leaking from the pen tip part 9.

To describe in details, in the state that the pen tip part 9 turns downward, the ink in the ink occlusion body moves downward by a dead weight, and therefore it wets the vicinity of a concave part 7*c* in an ink holder. The ink guiding path 20 is composed of a very narrow slit and therefore has capillary force. Accordingly, it has the action to draw the ink in the ink holder concave part 7*c*. As a result, the gas-liquid exchange part 11 which communicates with the ink guiding path 20 can be wetted as well to keep the ink head H1, so that the ink can be prevented from leaking from the pen tip part 9. The ink guiding path 20 may be formed in a sponge form or a fiber form in addition to the slit form described above.

BEST MODE FOR CARRYING OUT THE INVENTION

The present invention shall be explained based on examples while referring to drawings.

EXAMPLE 1

Figure 1:
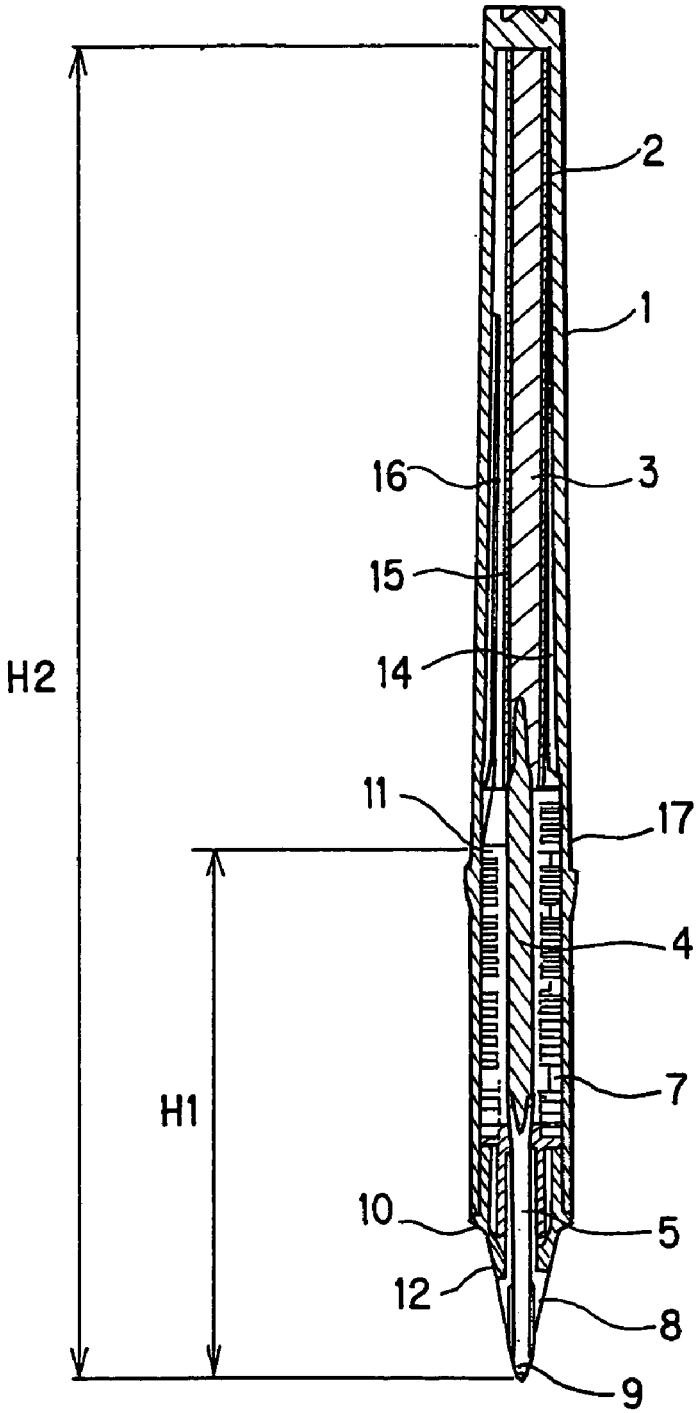
FIG. 1 is a cross section showing the first embodiment of the present invention.

First, the first embodiment of the present invention shall be explained with reference to FIG. 1, FIG. 2 and FIG. 3. An ink occlusion body 3 having an outer skin 2 and a guide 14 are mounted in an ink tank 1, and an ink holder 7 is pressed therein and fixed. A screw part 17 is provided on the outside surface of the ink tank 1, and an outside barrel which is not illustrated is installed. A connecting part 10, a mouthpiece part 8 and a pen tip part 9 are installed to the front (pen tip part 9 side) of the ink holder 7, and an outside air-introducing hole 12 is formed. A ballpoint pen tip is mounted on the pen tip part 9.

The guide 14 has a function to fix and hold the ink occlusion body 3 and to discharge expanded air to the outside of the writing instrument through a ventilating part 16 when air in the ink tank 1 is expanded. The expanded air is discharged through a gas-liquid exchange part 11, a vertical groove 21 and the outside air-introducing hole 12 after passing through the ventilating part 16. The ink in the ink tank 1 advances to the vertical groove 21 after passing through the gas-liquid exchange part 11. A narrow ink holder groove part 7*b* is formed between ink holder tooth parts 7*a* and has capillary force, and therefore it holds the ink of the vertical groove 21.

In the embodiment of the present invention, a feed 4 and a pen feed 5 are used as an ink guiding part. The feed is a different part from the pen feed in the embodiment of the present invention, but they may be integrated. Through holes 15 are bored in line on the side face of the ink occlusion body 3 in a axial direction, and the ink enters the ink occlusion body 3 through these through holes 15 to prevent a void part from being produced. The feed 4 which is the ink guiding part is inserted into the ink occlusion body 3 and connected therewith to guide the ink in the ink occlusion body 3 to the pen tip part 9.

Figure 2:
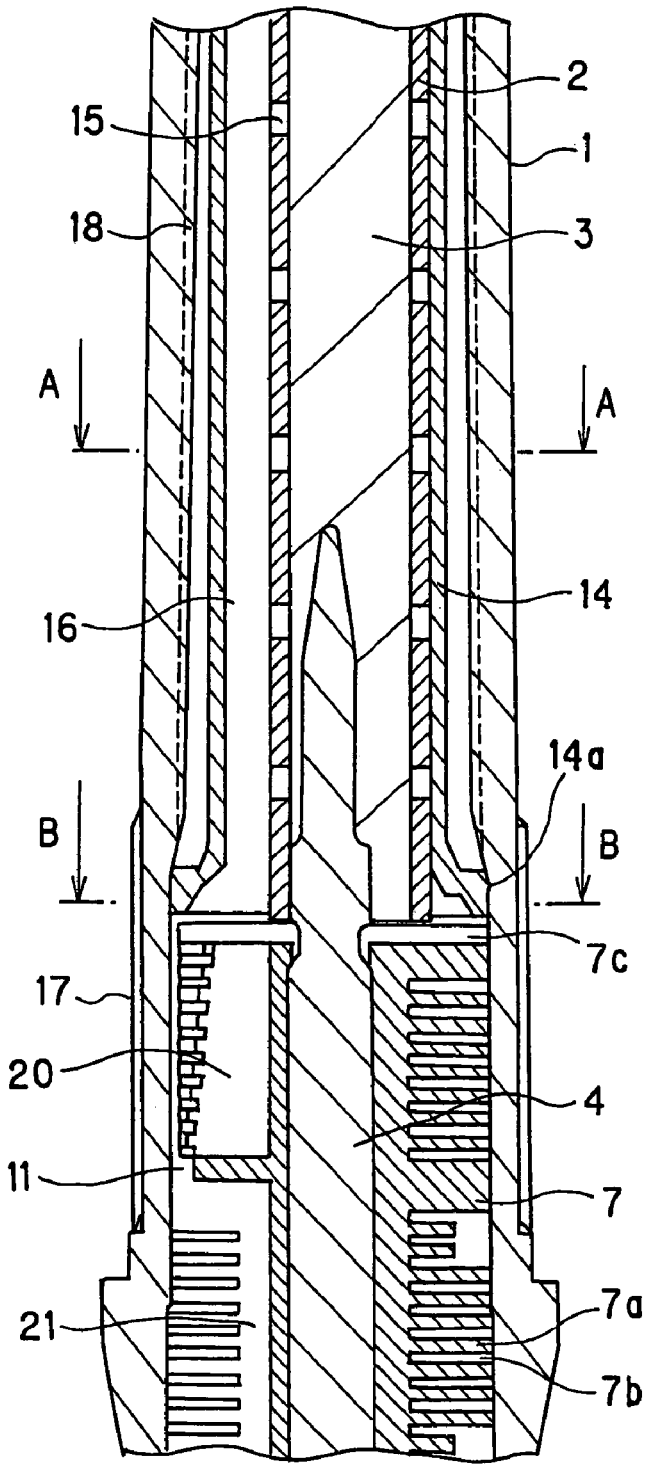
FIG. 2 is a partially enlarged drawing showing the first embodiment.
Figure 3:
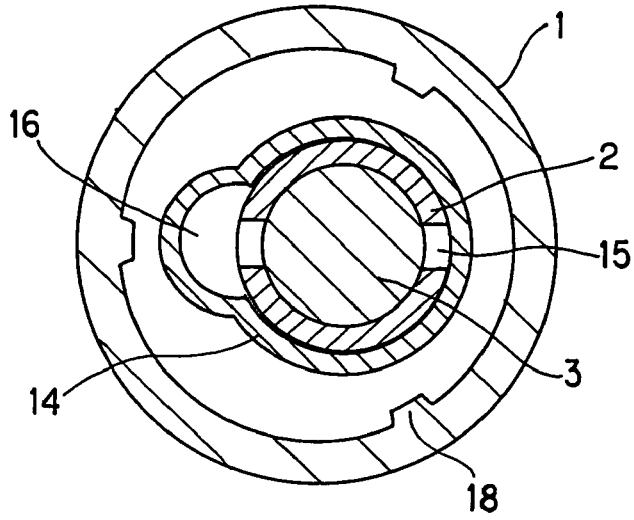
FIG. 3 is an A—A line cross section in FIG. 2.
Figure 4:
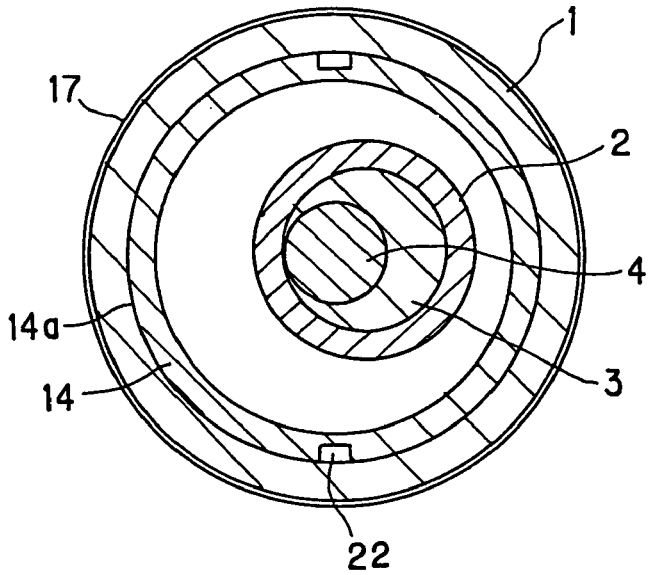
FIG. 4 is a B—B line cross section in FIG. 2.

FIG. 4 is a B—B line cross section in FIG. 2. A notch 22 is provided on the guide 14. The guide 14 is pressed into the ink tank 1, and therefore the ink is restricted in moving from a guide pressing part 14*a* to a pen tip part 9. Accordingly, if this notch 22 is not provided, there is the problem that the ink remains between the guide 14 and the inner wall of the ink tank 1 and can not effectively be consumed. Thus, the ink can be moved by providing the notch 22, so that it can effectively be consumed.

Figure 5:
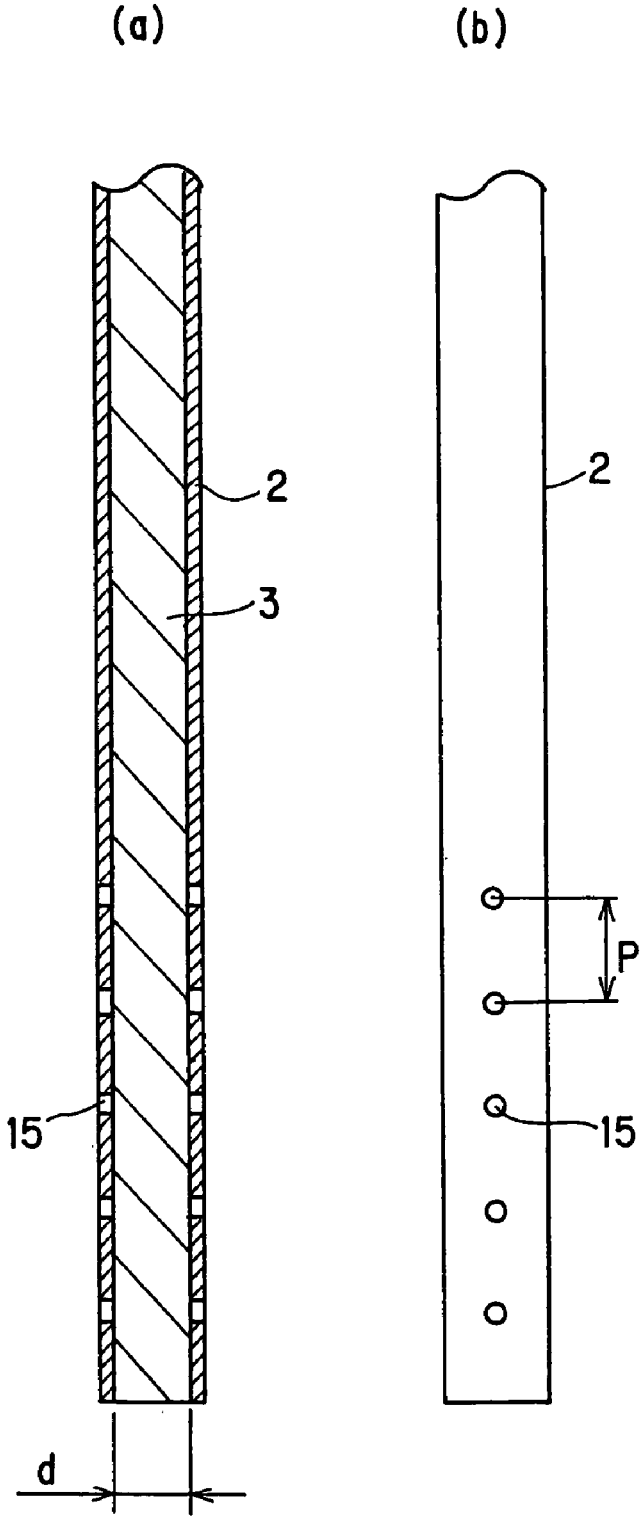
FIG. 5 is an enlarged drawing of the ink occlusion body in the first embodiment.

FIG. 5 is an enlarged drawing of the ink occlusion body in the first embodiment. The ink occlusion body 3 is made of polyethylene terephthalate (PET) or polypropylene (PP), and the circumference of this ink occlusion body 3 is covered with an outer skin 2 of polypropylene (PP). In the present example, the ink occlusion body 3 in FIG. 5 has an outer diameter d of 3.5 mm; a pitch P showing an interval between the through holes 15 which are through parts is 3.5 mm; and the through holes 15 have a diameter of 0.5 mm. The through holes 15 are provided at five portions in line respectively in an axial direction on both side faces of the outer skin.

Figure 6:
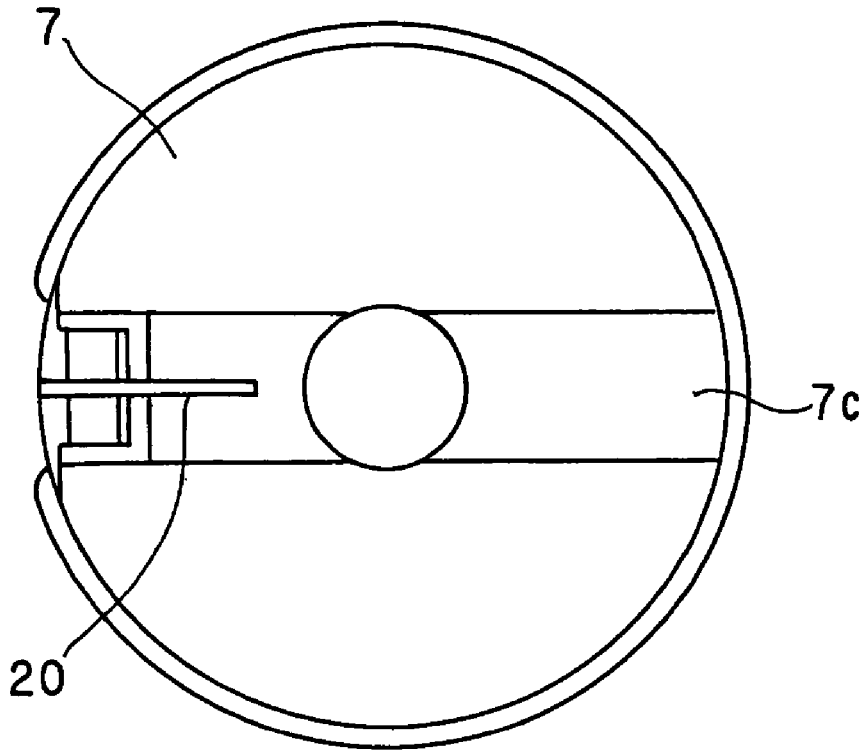
FIG. 6 is a plan drawing of the ink holder in the first embodiment.

FIG. 6 is a plan drawing of the ink holder 7 in the first embodiment. The ink holder concave part 7*c* is provided on a side opposite to the pen tip part 9 of the ink holder 7. The ink guiding path 20 connected to the gas-liquid exchange part 11 is further provided at the concave part 7*c*, and the capillary force of the ink guiding path 20 draws the ink to finally wet the gas-liquid exchange part 11.

EXAMPLE 2

Figure 7:
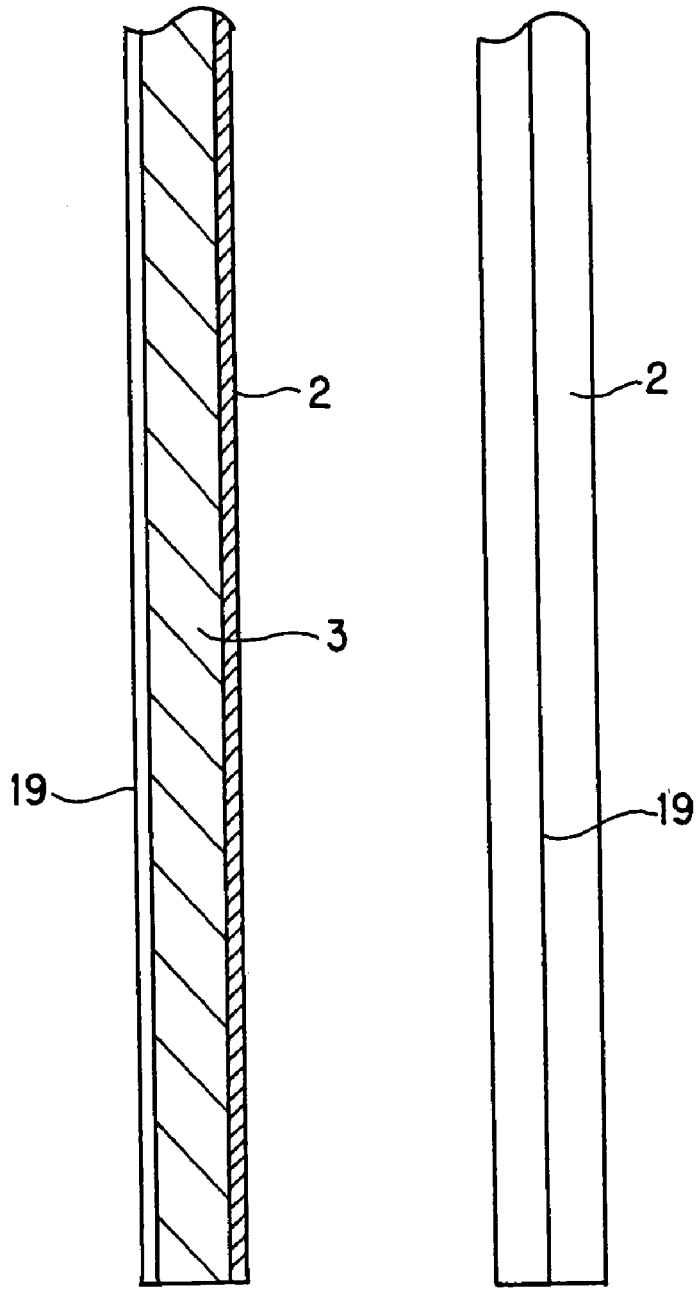
FIG. 7 is an enlarged drawing of the ink occlusion body in the second embodiment.

FIG. 7 is an enlarged drawing of the ink occlusion body in the second embodiment. A slit 19 is provided in the outer skin 2, and the ink enters the ink occlusion body 3 through the slit 19. The slit 19 is provided over the whole length in the embodiment of the present example, but it does not necessarily have to be provided over the whole length and may be partially provided. It is more preferably provided at the pen tip part 9 side of the middle.

EXAMPLE 3

Figure 8:
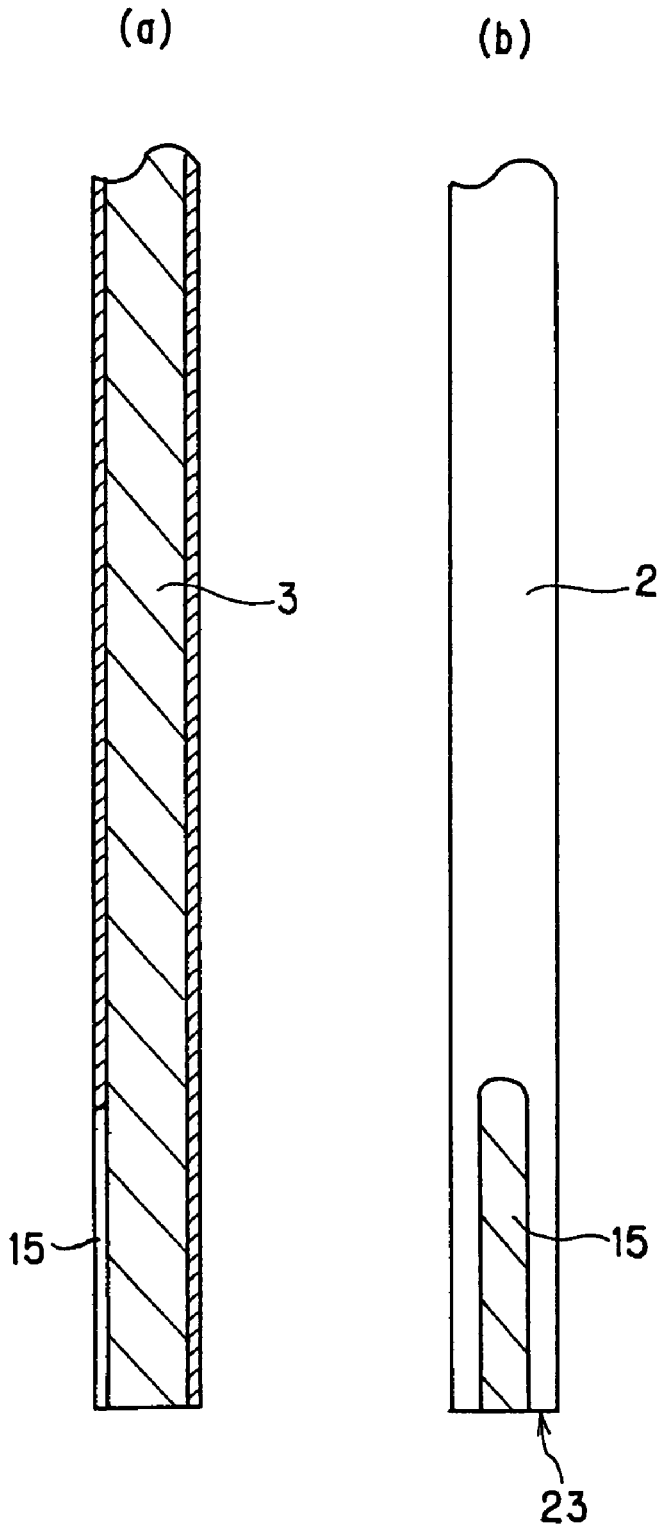
FIG. 8 is an enlarged drawing of the ink occlusion body in the third embodiment.
Figure 9:
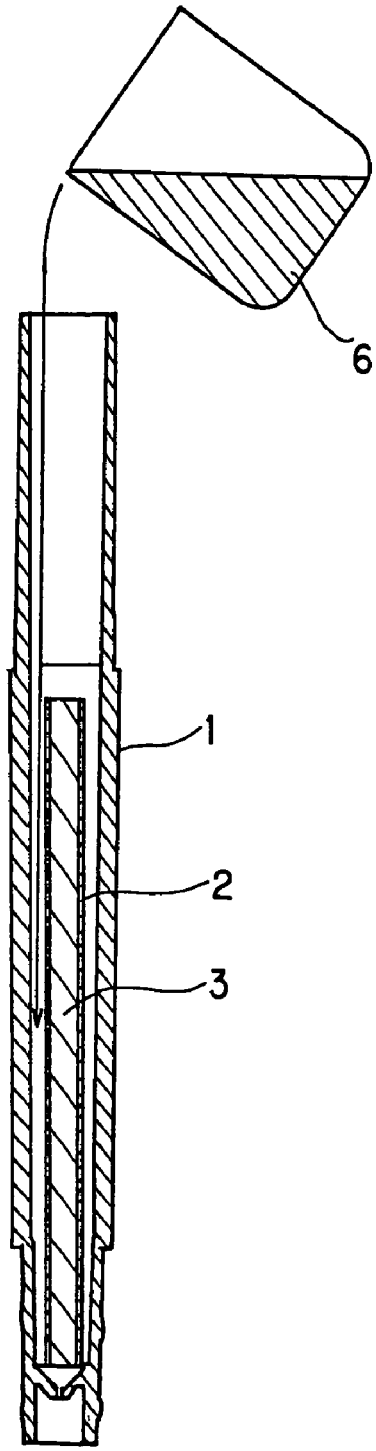
FIG. 9 is an explanatory drawing in injecting the ink into the ink tank.
Figure 10:
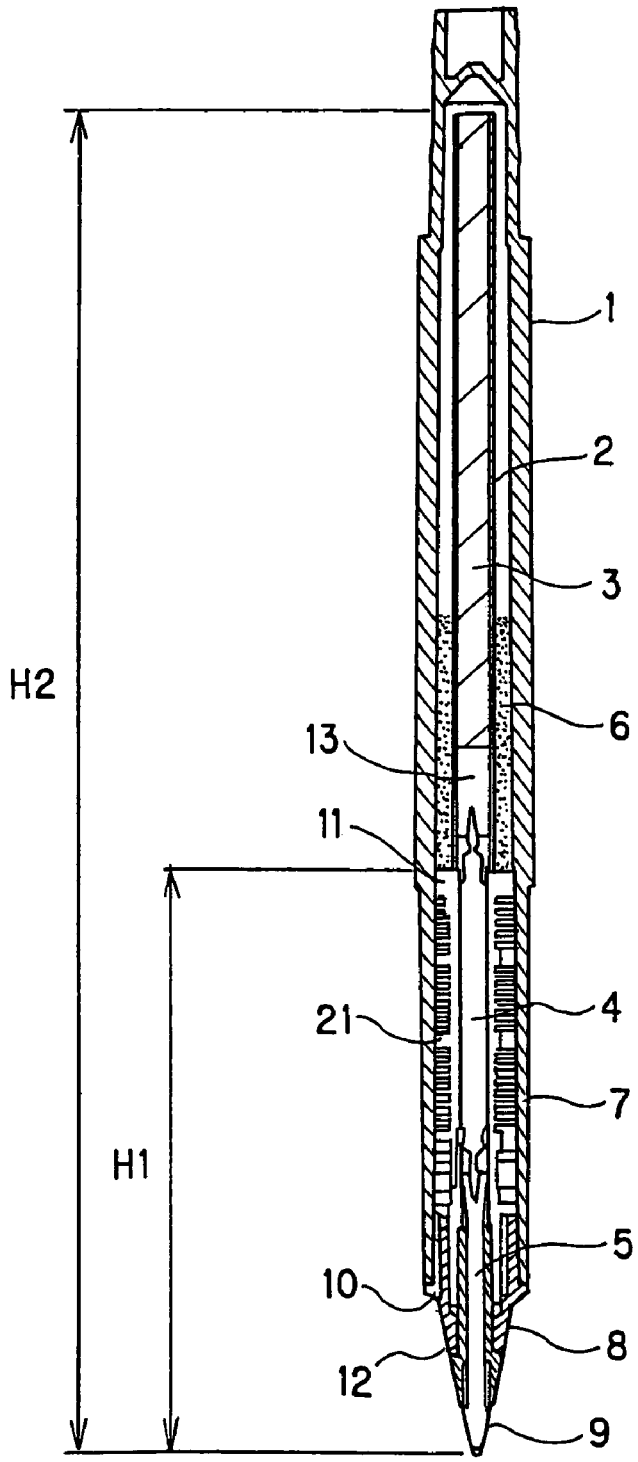
FIG. 10 is an explanatory drawing in injecting the ink into the ink tank.

FIG. 8 is an enlarged drawing of the ink occlusion body in the third embodiment. The through hole 15 is provided in the outer skin 2 extending from an end part (23) of the pen tip side of the occlusion body.

INDUSTRIAL APPLICABILITY

The present invention relates to an ink occlusion body having an outer skin which is mounted in an inside of an ink tank and which is provided with a through part in the outer skin, and it is suited to a ballpoint pen and a felt-tip pen. It can be prevented a void part therein from being produced and makes it possible to effectively consume an ink and prevent inferior writing.

The invention claimed is:

1. A writing instrument comprising:

an ink tank for holding a liquid ink in an inside thereof, an ink holder which can hold the ink in the ink tank and which controls an internal pressure in the ink tank, a pen tip, an ink introducing part for introducing the ink in the ink tank to the pen tip and an ink occlusion body comprising an outer ink occlusion body cover and an inner ink occlusion body member, the ink occlusion body being mounted in the ink tank so as to feed the ink to the ink introducing part, wherein through parts are provided in a line in an axial direction in the outer ink occlusion body cover at the pen tip rather than in the center of the ink occlusion body such that ink enters the inner ink occlusion body member by way of the through parts, and wherein the ink introducing part is inserted into the inner ink occlusion body member so as to introduce ink from the inner ink occlusion body member to the pen tip.

2. The writing instrument as described in claim 1, wherein on the assumption that an outer diameter of the ink occlusion body is d and a pitch at which the through parts are provided is P, P is not more than 2 d.

3. The writing instrument as described in claim 2, wherein the ink holder has a gas-liquid exchange part and an ink-introducing groove for introducing the ink to the above gas-liquid exchange part.

4. The writing instrument as described in claim 1, wherein the ink holder has a gas-liquid exchange part and an ink-introducing groove for introducing the ink to the above gas-liquid exchange part.

5. A writing instrument comprising:

an ink tank for holding a liquid ink in an inside thereof, an ink holder which can hold the ink in the ink tank and which controls an internal pressure in the ink tank, a pen tip, an ink introducing part for introducing the ink in the ink tank to the pen tip, and an ink occlusion body comprising an outer ink occlusion body cover and an inner ink occlusion body member, the ink occlusion body being mounted in the ink tank so as to feed the ink to the ink introducing part, wherein through parts are through holes or slits and are provided in the outer ink occlusion body cover at the pen tip rather than in the center of the ink occlusion body such that ink enters the inner ink occlusion body member by way of the through parts, and wherein the ink introducing part is inserted into the inner ink occlusion body member so as to introduce ink from the inner ink occlusion body member to the pen tip.

6. The writing instrument as described in claim 5, wherein the ink holder has a gas-liquid exchange part and an ink-introducing groove for introducing the ink to the above gas-liquid exchange part.

* * * * *